US012352434B2

(12) United States Patent
Moon

(10) Patent No.: US 12,352,434 B2
(45) Date of Patent: Jul. 8, 2025

(54) GAS BURNER

(71) Applicant: MOAI INC., Gwacheon-si (KR)

(72) Inventor: Seong Cheol Moon, Gwacheon-si (KR)

(73) Assignee: MOAI INC., Gwacheon-si (KR)

( * ) Notice: Subject to any disclaimer, the term of this patent is extended or adjusted under 35 U.S.C. 154(b) by 0 days.

(21) Appl. No.: 18/721,204

(22) PCT Filed: Dec. 21, 2022

(86) PCT No.: PCT/KR2022/020981
§ 371 (c)(1),
(2) Date: Jun. 18, 2024

(87) PCT Pub. No.: WO2023/121305
PCT Pub. Date: Jun. 29, 2023

(65) Prior Publication Data

US 2024/0418363 A1 Dec. 19, 2024

(30) Foreign Application Priority Data

Dec. 25, 2021 (KR) ..... 10-2021-0187876

(51) Int. Cl.
*F23D 14/06* (2006.01)
*F23D 14/72* (2006.01)

(52) U.S. Cl.
CPC ..... *F23D 14/065* (2013.01); *F23D 14/72* (2013.01); *F23D 2900/14062* (2013.01); *F23D 2900/14063* (2013.01)

(58) Field of Classification Search
CPC ..... F23D 14/065; F23D 14/72; F23D 2900/14062; F23D 2900/14063
See application file for complete search history.

(56) References Cited

U.S. PATENT DOCUMENTS

| | | | | |
|---|---|---|---|---|
| 9,453,641 | B2 | 9/2016 | Cadima | |
| 2010/0092902 | A1* | 4/2010 | Paesani | F23D 14/065 431/354 |
| 2015/0219340 | A1 | 8/2015 | Cadima | |
| 2018/0135851 | A1 | 5/2018 | Biagioli et al. | |
| 2019/0346135 | A1 | 11/2019 | Cadima | |
| 2020/0408402 | A1 | 12/2020 | Gerdes | |

FOREIGN PATENT DOCUMENTS

| | | | |
|---|---|---|---|
| KR | 10-2007-0053914 | A | 5/2007 |
| KR | 10-2017-0139579 | A | 12/2017 |
| KR | 10-1887258 | B1 | 8/2018 |

OTHER PUBLICATIONS

International Search Report for PCT/KR2022/020981 mailed Apr. 6, 2023 from Korean Intellectual Property Office.

* cited by examiner

*Primary Examiner* — Alfred Basichas
(74) *Attorney, Agent, or Firm* — Revolution IP, PLLC

(57) ABSTRACT

A gas burner for a cooking appliance is a gas burner including a head, an injector holder, a Venturi tube, and an injector, wherein a pair of first Venturi tubes each directly communicate with one of expansion chambers separately formed in the injector holder, each of the expansion chambers communicates with an outer annular chamber through an upright vertical channel thereof, an upper surface of the injector holder is flat, and a second injector is positioned higher than the upper surface of the injector holder and is open.

3 Claims, 9 Drawing Sheets

GAS BURNER

TECHNICAL FIELD

The present invention relates to a gas burner for a cooking appliance.

Background Art

A gas burner for a cooking appliance is configured to include an injector holder configured to fix an injector for injecting gas and introduce primary air and a head having an upper portion closed with a cap to provide a flame ring and having a plurality of flame ports configured to discharge a gas/primary air mixture (hereinafter referred to as "gas/air mixture").

Primary air and secondary air are necessary for a burner to burn gas. Primary air is air directly introduced when a gas is ejected, and secondary air is air supplied from the surroundings when a flame ring is formed. Primary air and secondary air should be appropriately supplied to allow a burner to effectively burn gas and secure safety of the burner.

Burners are classified into a single type, a dual type, a triple type, and the like according to flame rings and classified into a horizontal type, an inclined type, a vertical type, and the like according to a direction in which flames are ejected.

A single type burner is configured to have one or more flame rings and is used along with a one-way valve. A dual type burner has an outer part disposed at an outer side and having high heating power and an inner part disposed at the center and having low heating power formed in a single head, thus having dual rings, and is used along with a two-way valve for each flame ring to be adjusted. A triple type burner has triple rings typically by adding a flame ring at an inner side of the outer part of the dual type burner. These burners are effectively used according to the use and purpose in consideration of cooking.

Burners have heating power that is adjustable in a wide range from high heating power to low heating power to enable various cooking methods to be performed quickly. In this case, burners should obtain sufficient primary air and secondary air at high heating power to maximally prevent incomplete combustion and maintain flames without extinguishing the flames at predetermined low heating power. For safety, preventing flames from being extinguished at predetermined low heating power is also required for a single type burner as well as a dual type burner.

In order to obtain high heating power, burners should significantly increase primary air and secondary air proportionally to the amount of injected gas to improve combustibility and smoothly discharge burned gas. Factors that significantly increase primary air and secondary air include a structure of an injector, the number and arrangement of Venturi tubes, the shape and size of Venturi tubes, a flow structure of a gas/air mixture, the arrangement of flame rings, the structure and method for introducing secondary air, and the like.

In particular, for the flow structure of a gas/air mixture, there is a need to increase the amount of primary air by minimizing a distance to a head. That is, resistance of a passage along which a gas/air mixture discharged from a Venturi tube flows is minimized so that the gas/air mixture immediately reaches a head providing a flame ring. In this case, in a process of minimizing the distance to the head, it is ensured that flames are homogenized even though a flow of the gas/air mixture is biased.

Sometimes, due to high heating power of a burner, an object to be cooked flows over a container, falls onto a burner cap, and flows into the burner or flows to an upper surface of an injector holder in a cooking process. When cleanability of the burner is not good, it is very inconvenient to clean the burner. In the burner, a portion of the burner into which the fallen object to be cooked flows needs to be configured to be simple to facilitate cleaning.

In a gas burner of Korean Patent No. 10-1887258, a pair of long horizontal Venturi tubes and a single vertical Venturi tube are applied to an injector holder and an inner part, respectively, to obtain heating power, two branches made of arch-shaped channels without partitions are each disposed at a rear end of one of the horizontal Venturi tubes, vertical channels are disposed at both ends of the branches, a cavity is formed at an upper surface of the injector holder to fix an injector in the cavity and block the injector from the surroundings to prevent an object to be cooked or the like from being introduced thereinto, and primary air of the inner part is introduced through a predetermined passage.

Flame stability of a burner is influenced by a temporary lack of gas that occurs due to a rapid disturbing flow of surrounding air at low heating power, a backflow of gas around an injector due to quickly opening and closing an oven door, or instantaneous excessive primary air caused by a sudden change of a valve from high heating power to low heating power, and flames may be extinguished when the flames are not stable.

A flame stability chamber and a flame stability port are disposed in a head to prevent a burner from being turned off at predetermined low heating power. The flame stability chamber serves to store a gas/air mixture and supply the gas/air mixture to the flame stability port, and the flame stability port serves to maintain flames and provide reignition even when another flame port is temporarily turned off.

A gas burner of U.S. Pat. No. 9,453,641 B2 has a radial stability chamber and a simmer flame port disposed in a head to prevent flames from being extinguished at low heating power. That is, even when flames are not stable and flames of a flame port are extinguished, flames of the simmer flame port that are not extinguished become a reignition source and provide reignition to the flame port so that flames of the burner are maintained.

The present invention is technology related to increasing primary air, homogenizing flames, improving cleanability, and preventing extinguishing of flames in a burner.

DISCLOSURE

Technical Problem

The present invention is directed to providing a gas burner in which a flow of a gas/air mixture obtained by a Venturi effect in the burner is minimized to increase primary air, flames are homogenized, a structure is simplified to not only eliminate factors that interfere with supply of primary air but also facilitate a flow of a falling object to be cooked and make a portion that may be contaminated visible, and storability of a gas/air mixture for reignition is improved to enhance flame stability in a flame extinguishment prevention structure.

Technical Solution

According to the present invention, the above objective and additional objectives are implemented in a gas burner for a cooking appliance by technical means in which features disclosed in the independent claims are integrated and which are described below simply as non-limiting examples with reference to the accompanying drawings.

Advantageous Effects

According to the present invention, there is an effect of increasing primary air, thereby improving combustibility, securing high heating power of a burner, and homogenizing flames.

Also, according to the present invention, there is an effect of eliminating factors that may interfere with supply of primary air, thereby improving safety in combustion.

Also, according to the present invention, there is an effect of allowing a portion of the burner, into which a falling object to be cooked flows, to be flat and allowing the inside of the burner, which may be contaminated, to be visible, to facilitate cleaning of the burner.

In addition, according to the present invention, there is an effect of maintaining a reignition source, in which flames are not extinguished at predetermined low heating power, to prevent flames of the burner from being extinguished.

DESCRIPTION OF DRAWINGS

FIG. 2 is a see-through view of an injector holder in which an upper portion of the injector holder is see-through.

BEST MODE OF THE INVENTION

Figure 1:
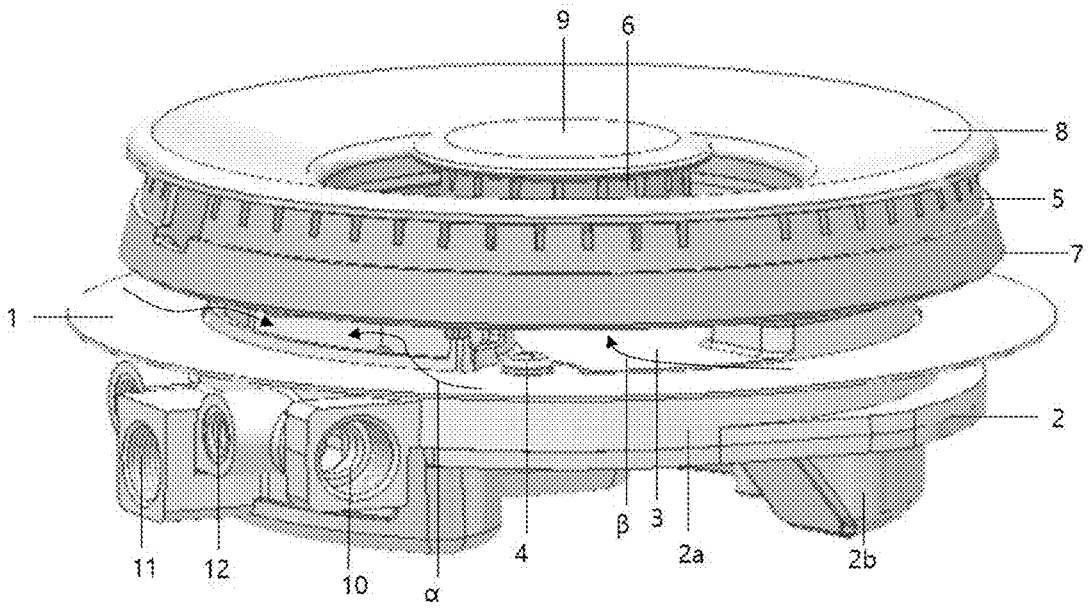
FIG. 1 is an overall view of a dual type burner according to an embodiment of the present invention.

In the present invention, specific embodiments are illustrated in the drawings, and details for carrying out the invention will be described in detail below. However, it is not intended to limit the present invention to specific embodiments, and it should be understood that the present invention includes all changes, equivalents, and substitutes included in the spirit and technical scope of the present invention. In describing each drawing, like reference numerals are used to denote like components.

Unless defined otherwise, all terms including technical or scientific terms used herein have the same meanings as generally understood by those of ordinary skill in the art to which the present invention pertains. Terms defined in commonly used dictionaries should be interpreted as having meanings consistent with their meanings in the context of the relevant art and should not be interpreted in an idealized or overly formal sense unless clearly defined in the present application.

Next, the invention relating to securing high heating power, improving cleanability, and preventing extinguishing of flames in a gas burner will be described in detail with reference to the accompanying drawings.

FIG. 1 is an overall view of a dual type burner according to an embodiment of the present invention.

The dual type burner is a burner in which an injector holder 2 is fixed to a top plate 1 of a cooking appliance by a fixing screw 4, a head 7 is disposed on the injector holder 2, a first cap 8 and a second cap 9 are placed on an outer part 5 and an inner part 6 of the head 7, respectively, and flames of the outer part 5 and the inner part 6 are separately adjusted by a two-way valve (not illustrated).

Figure 2:
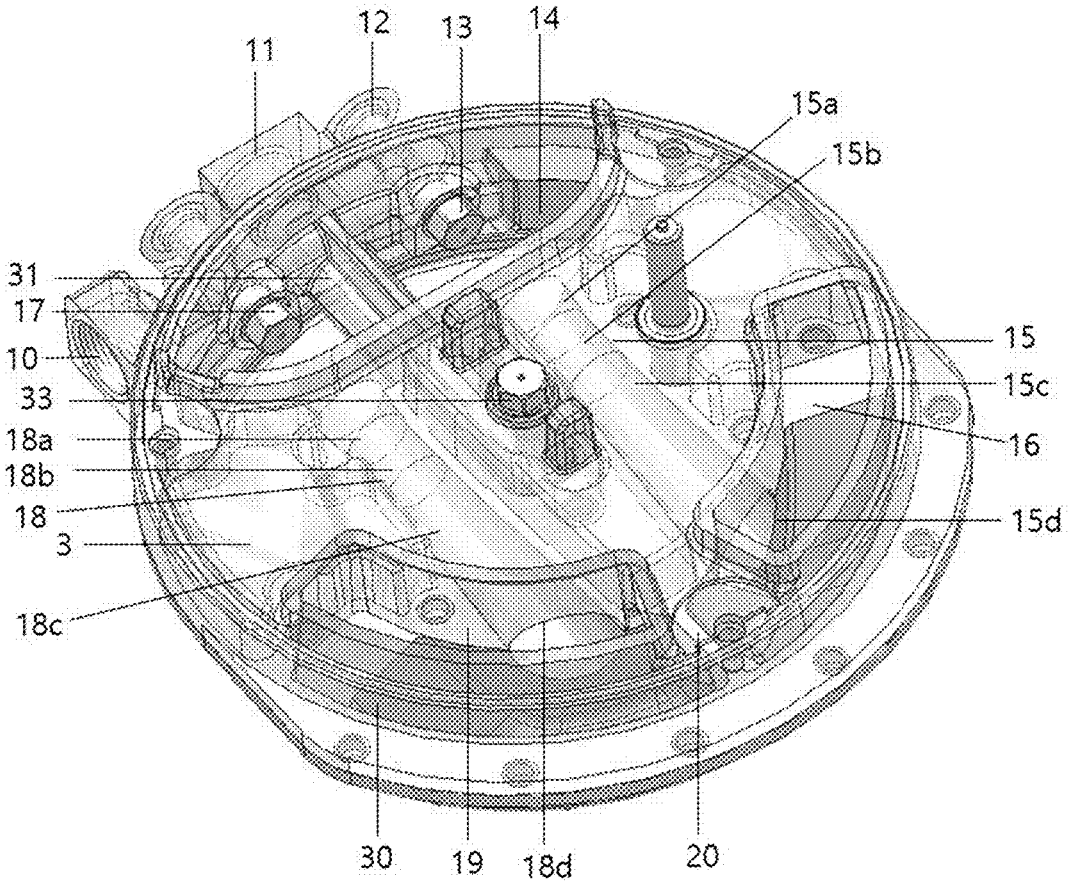

FIG. 2 is a see-through view of the injector holder in which an upper portion of the injector holder is see-through.

Figure 3:
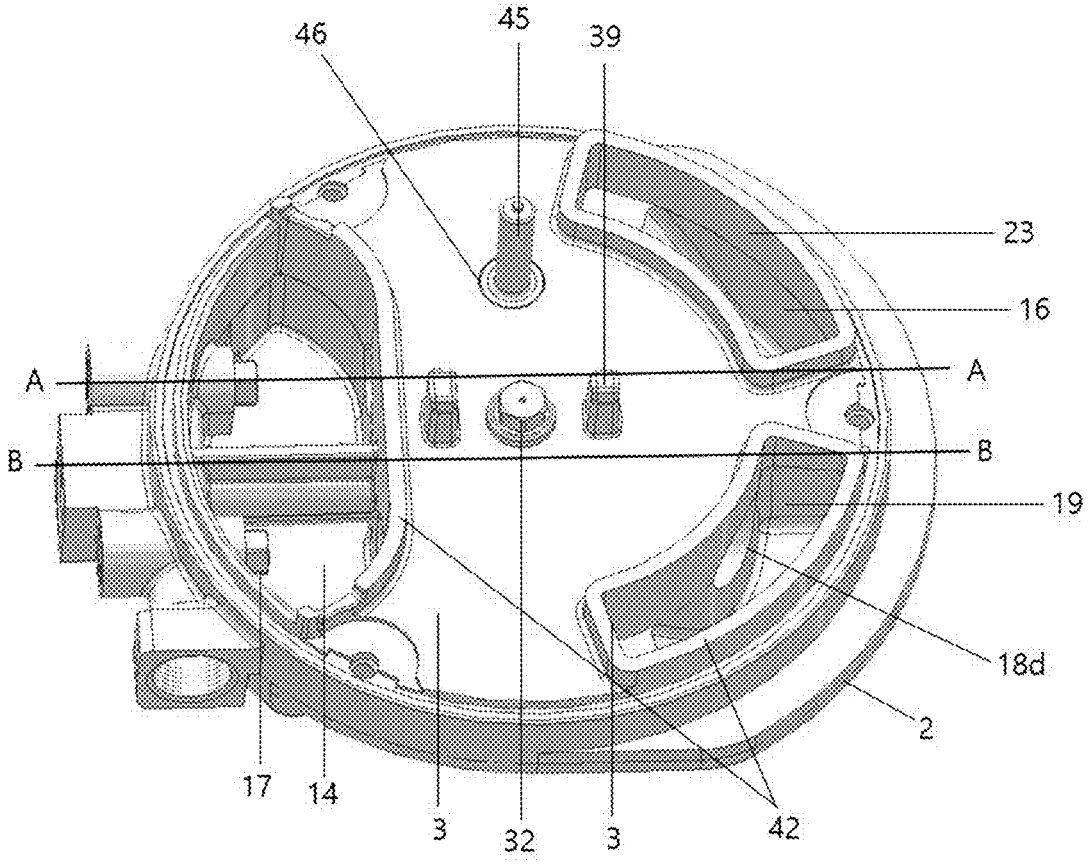
FIG. 3 is a partial view of the injector holder in which lines A-A and B-B are marked.
Figure 4:
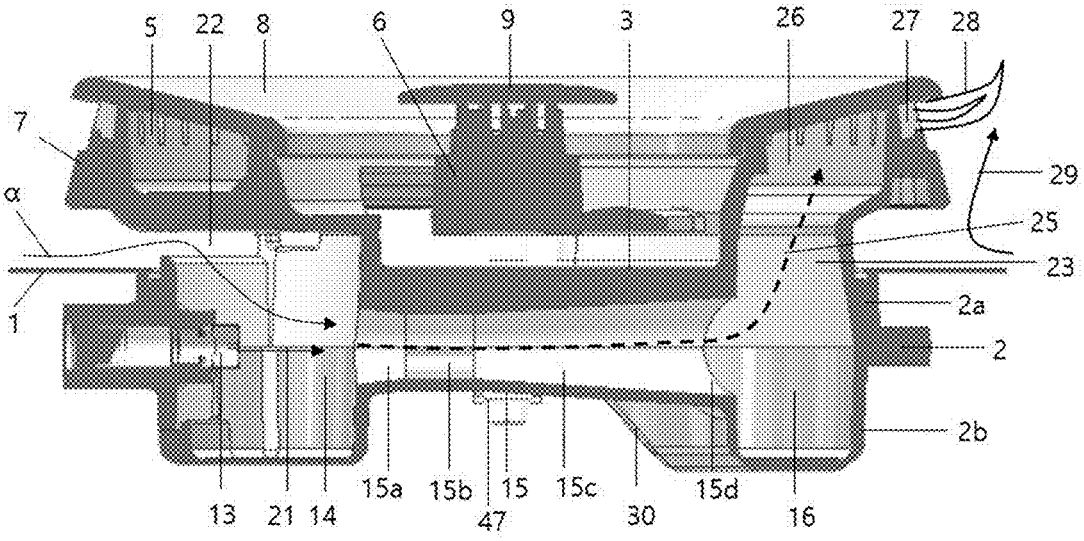
FIG. 4 is a cross-sectional view of the dual type burner along line A-A that illustrates a flow of a gas/air mixture through a first Venturi tube.
Figure 5:
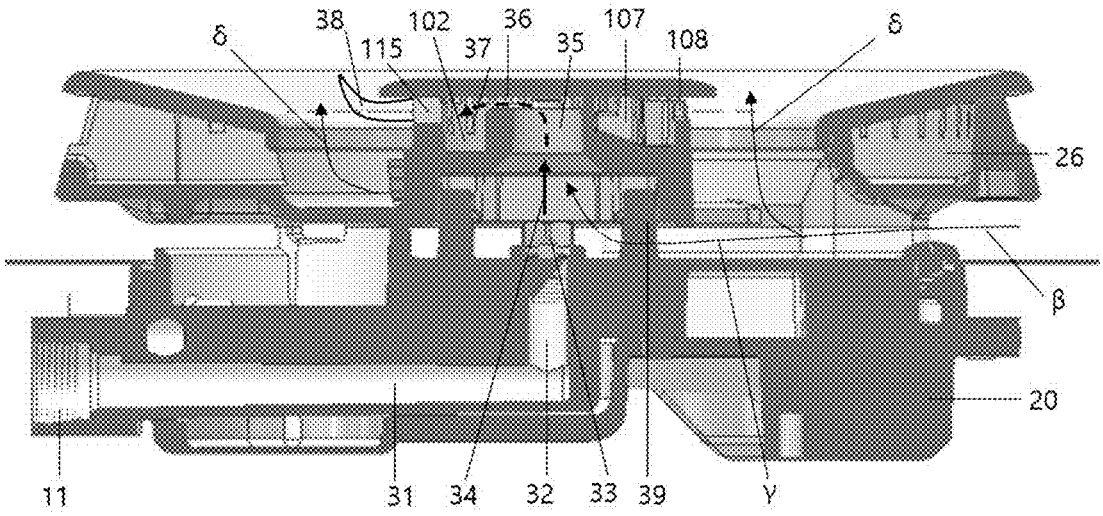
FIG. 5 is a cross-sectional view of the dual type burner along line B-B that illustrates a flow of the gas/air mixture through a second Venturi tube.

FIG. 3 is a partial view of the injector holder in which lines A-A and B-B are marked, and cross-sections along lines A-A and B-B are illustrated in FIGS. 4 and 5, respectively.

In the injector holder 2, an injector holder upper portion 2*a* and an injector holder lower portion 2*b* are coupled. A portion that supplies a gas/air mixture to the outer part 5 of the head 7 is configured to maintain communication continuity 25 in the order of a gas inlet 10, first injectors 13 and 17, a cavity 14, first Venturi tubes 15 and 18, expansion chambers 16 and 19, and vertical channels 23 and 24, and a portion that supplies the gas/air mixture to the inner part 6 of the head 7 is configured to have a gas inlet 11, a horizontal gas conduit 31, a vertical gas conduit 32, and a second injector 33 disposed in that order. Also, a protruding rim 43, an ignition electrode 45, an electrode holder 46, an electrode fixing spring 47, and the like are present to support the head 7. Although not illustrated, a thermocouple, a thermocouple holder, and a thermocouple fixing spring may also be included in the injector holder 2 as necessary.

FIG. 4 is a cross-sectional view of the dual type burner along line A-A that illustrates a flow of the gas/air mixture through the first Venturi tubes. FIG. 4 illustrates a process in which the gas/air mixture is supplied to the outer part 5 of the head 7.

The gas inlet 10 is disposed in a vertical outer wall of the injector holder 2 to allow introduction of gas that has passed through a valve and a gas pipe (not illustrated) and allows the gas to flow to the first injectors 13 and 17.

The first injectors consist of the pair of injectors 13 and 17 spaced apart from each other and are disposed perpendicular to the outer wall to horizontally inject the gas introduced from the gas inlet 10. Diameters of outlets of the first injectors 13 and 17 limit an amount of injected gas and thus determine heating power of the outer part 5.

The cavity 14 is disposed between the first injectors 13 and 17 and the first Venturi tubes 15 and 18 so that the first injectors 13 and 17 and the first Venturi tubes 15 and 18 are spaced apart at a predetermined interval. The cavity 14 is an empty space that, when a gas is injected (21) from the first injectors 13 and 17, allows primary air $\alpha$ to be introduced between the upper portion of the injector holder 2 and the lower portion of the head 7 and introduced into the first Venturi tubes 15 and 18 together with the gas. The cavity 14 may either be a top breather having a closed bottom and an open top or a bottom breather having a closed top and an open bottom, and an example in which the cavity 14 is a top breather is shown in FIG. 4.

The first Venturi tubes consist of the pair of Venturi tubes 15 and 18, and the Bernoulli's equation is applied thereto to introduce the primary air $\alpha$ by a Venturi effect. The Venturi tubes being disposed in a vertical direction, which is a direction opposite to the direction of gravity, is unfavorable for introducing the primary air, and thus the first Venturi tubes are disposed horizontally to introduce more primary air and obtain high heating power. The first Venturi tubes 15 and 18 include inlets 15*a* and 18*a*, throats 15*b* and 18*b*, and diffusers 15*c* and 18*c*, respectively. Center lines of the first injectors 13 and 17 and the first Venturi tubes 15 and 18 horizontally coincide with each other to maximize the amount of primary air α introduced into the first Venturi tubes.

For a flow structure of the gas/air mixture, there is a need to increase the amount of primary air by minimizing a distance to the head. That is, resistance of a passage along which the gas/air mixture discharged from the Venturi tubes flows is minimized so that the gas/air mixture immediately reaches the head providing a flame ring. In this case, in a process of minimizing the distance to the head, it is ensured that flames are homogenized even though a flow of the gas/air mixture is biased. Specific embodiments related thereto are described below.

The expansion chambers 16 and 19 are disposed directly at outlets 15*d* and 18*d* of the first Venturi tubes to communicate with the diffusers 15*c* and 18*c* of the first Venturi tubes without any channel or tunnel therebetween. Such arrangement of the expansion chambers 16 and 19 reduces resistance to the flow of the gas/air mixture discharged from the first Venturi tubes and maximizes the amount of primary air α introduced into the expansion members 16 and 19. A separating partition 20 for separating the expansion chambers 16 and 19 is installed for each of the expansion chambers 16 and 19 to be a chamber of one of the pair of first Venturi tubes 15 and 18 to prevent gas/air mixtures discharged from the first Venturi tubes 15 and 18 from colliding with each other, forming a turbulent flow, and interfering with the flow of the gas/air mixture. The expansion chambers 16 and 19 increase an internal volume to contribute to allowing the gas/air mixture that passes through the outlets 15*d* and 18*d* of the first Venturi tubes to be rapidly dispersed and immediately flow upward to the vertical channels 23 and 24 and homogenizing an outer flame ring 28. However, the pair of vertical channels 23 and 24 may be disposed close to each other instead of being maximally spaced apart from each other along the diameter of the injector holder 2 and may cause the flow of the gas/air mixture to be biased and hinder homogenization of flames. Accordingly, the expansion chambers 16 and 19 induce smooth flow and distribution of the gas/air mixture to the vertical channels 23 and 24, which are disposed close to each other while a distribution inclined surface 30 is disposed at the injector holder lower portion 2*b* at a portion far from the outlets 15*d* and 18*d* of the first Venturi tubes, and an outer annular chamber 26. Also, the distribution inclined surface 30 may be disposed at a portion closer to the outlets 15*d* and 18*d* of the first Venturi tubes to change the flow of the gas/air mixture and further homogenize the distribution of the gas/air mixture in the outer annular chamber 26.

The vertical channels 23 and 24 are disposed right above the expansion chambers 16 and 19 and allow the gas/air mixture that has reached the expansion chambers 16 and 19 to immediately flow upward to the outer annular chamber 26 of the outer part 5. Cross-sectional areas of the vertical channels 23 and 24 have the same sizes as cross-sectional areas of the expansion chambers 16 and 19 to ensure that there is no flow resistance of the gas/air mixture.

As shown in FIG. 4, the gas injected from the first injectors 13 and 17 becomes the gas/air mixture due to the primary air α being introduced through the cavity 14 due to the Venturi effect of the first Venturi tubes 15 and 18, and the gas/air mixture reaches the outer annular chamber 26 of the outer part 5 via the expansion chambers 16 and 19, which directly communicate with the outlets 15*d* and 18*d* of the first Venturi tubes, and the vertical channels 23 and 24 disposed right above the expansion chambers 16 and 19. In this communication continuity 25, the distance, flow resistance, and vortex are minimized to increase the primary air α, aim to improve combustibility of the burner, and secure high heating power of the burner.

FIG. 5 is a cross-sectional view of the dual type burner along line B-B that illustrates a flow of the gas/air mixture through a second Venturi tube. FIG. 5 illustrates a process in which the gas/air mixture is supplied to the inner part 6 of the head 7.

The gas inlet 11 is disposed to pass through the vertical outer wall of the injector holder 2 to allow introduction of gas that has passed through a valve and a gas pipe (not illustrated) and communicates with the second injector 33 via the horizontal gas conduit 31 and the vertical gas conduit 32.

The second injector 33 is vertically disposed at the center of an upper surface 3 of the injector holder upper portion to inject gas to a second Venturi tube 35 vertically disposed at the center of the inner part 6 of the head 7. Since heating power of the inner part 6 is low, the inner part 6 is disposed vertically, rather than being disposed horizontally, to reduce an area occupied by the inner part 6.

As illustrated in FIG. 3, the second injector 33 completely protrudes from the flat upper surface 3 of the injector holder upper portion 2*a* without being recessed in the form of a cup or being disposed in the cavity, is open to communicate with the surroundings, and is positioned higher than the upper surface 3 of the injector holder. The second injector 33 and the second Venturi tube 35 are disposed to be spaced apart at a predetermined interval, and since the second injector 33 is positioned higher than the upper surface 3 of the injector holder upper portion, a length of the second Venturi tube 35 is reduced to maintain the predetermined interval.

As illustrated in FIG. 5, air β introduced through a space between the upper surface 3 of the injector holder upper portion and the lower portion of the head 7 is used as primary air γ and secondary air δ of the inner part 6 and secondary air δ of the outer part 5. In particular, since the primary air γ for the inner part 6 can be immediately obtained from the open surroundings without a limited tunnel or passage, in the present invention, factors that may interfere with supply of the primary air, such as blockage of a channel or a passage due to an object to be cooked falling thereinto, can be eliminated, the structure can be simplified, and thus there is no concern about situations in which safety in combustion is compromised or incomplete combustion occurs due to a failure in introducing the primary air.

FIGS. 3 and 5 show that the upper surface 3 of the injector holder is flat without a recess or cavity, and protrusion of the upper surface 3 of the injector holder is minimized to ensure convenient cleaning without difficulty even when an object to be cooked falls, and the second injector 33 is positioned higher than a base surface at a central portion of the inner part 6 of the head 7 to prevent the falling object to be cooked from coming in contact therewith. Meanwhile, since a channel, a passage, or the like is not present in the expansion chambers 16 and 19, and bottom surfaces of the expansion chambers 16 and 19 are entirely visible, even when the falling object to be cooked is introduced into the expansion chambers 16 and 19 via the vertical channels 23 and 24 through an outer flame port 27 of the outer part 5 and causes the expansion chambers 16 and 19 to be contaminated, cleaning is possible without the need to disassemble the burner.

Figure 6:
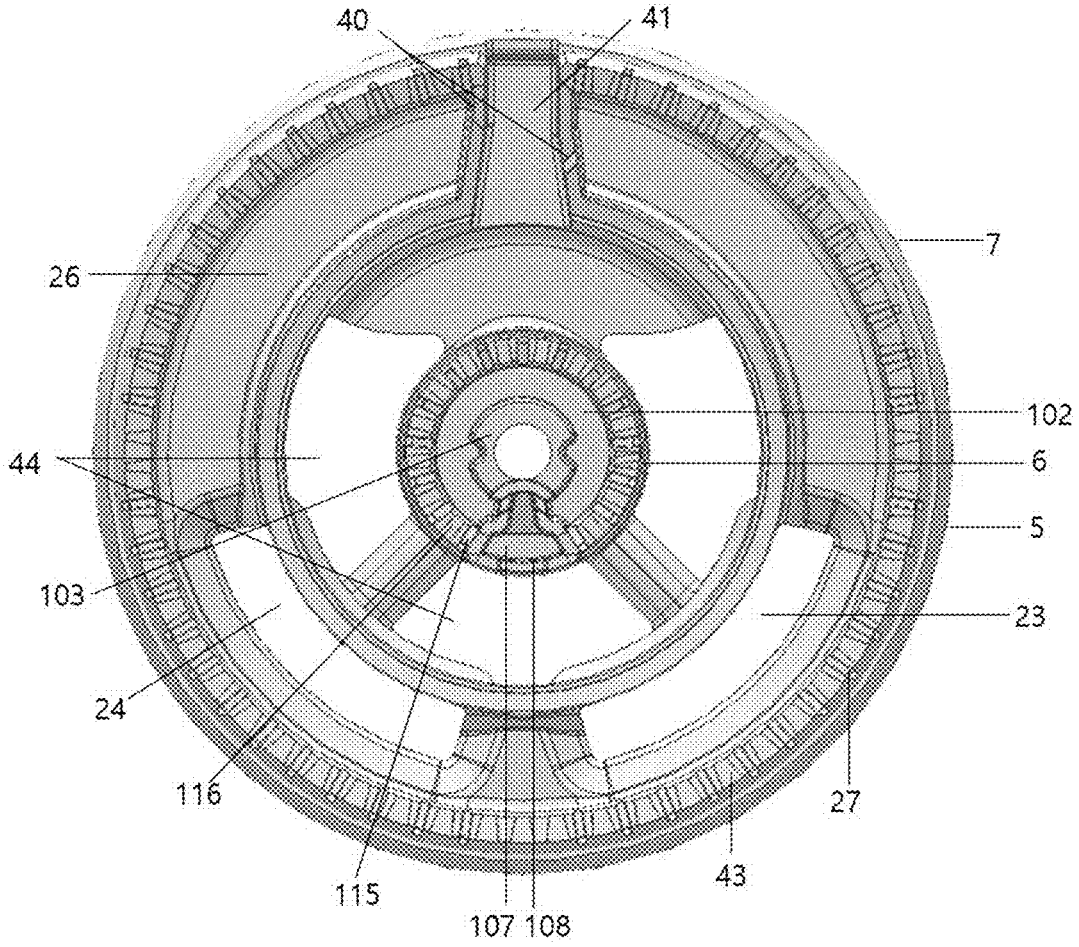
FIG. 6 is a plan view of a head including an outer part and an inner part.

FIG. 6 is a plan view of the head including the outer part and the inner part.

The head 7 includes the outer part 5, the inner part 6, a secondary air δ inlet which is an open space between the outer part 5 and the inner part 6, and a flame transfer port 40 and a flame transfer tunnel 41 configured to transfer flames from the inner part 6 to the outer part 5.

The outer part 5 includes the outer annular chamber 26 configured to communicate with outlets of the vertical channels 23 and 24 and hold and distribute the gas/air mixture and outer flame ports 27 and 43 configured to eject the gas/air mixture. As shown in FIG. 4, the gas/air mixture that has passed through the vertical channels 23 and 24 immediately flows upward to the outer annular chamber 26 and is distributed to a main outer flame port 27 and an auxiliary outer flame port 43 of each part to obtain secondary air 29 and form the outer flame ring 28. Also, the gas/air mixture of the outer annular chamber 26 may be ejected through a flame port (not illustrated) in a direction of the inner part 6, which is inward from the outer part, to form an additional flame ring (not illustrated). In this way, a triple type burner having triple rings may be formed.

The inner part 6 includes the second Venturi tube 35 which is an inlet for the gas/air mixture injected from the second injector 33, a throat 36 configured to increase a flow speed of the gas/air mixture to introduce and discharge the primary air γ, a gas/air mixture chamber 102 configured to hold and distribute the gas/air mixture, flame ports 115 and 116 configured to eject the gas/air mixture, an inner flame ring 38, and a flame stability chamber 107 and a flame stability port 108 configured to maintain a reignition source whose flames are not extinguished. When necessary, the flame stability chamber 107 and the flame stability port 108 may not be included and may be replaced with the flame ports 115 and 116.

Coupling between the injector holder 2 and the head 7 is performed by a protruding rim 42 of the injector holder 2, a rim (not illustrated) at a lower end of the head 7, and a fixing pole 39, combustion air α and β is introduced through a gap between the injector holder 2 and the head 2, and when an object to be cooked falls, the object to be cooked is allowed to flow to the top plate 1 of the cooking appliance.

The first cap 8 closes an upper portion of the outer annular chamber 26 of the outer part 5 to cause the gas/air mixture to be ejected through the outer flame ports 27 and 43 and provide the outer flame ring 28, and the second cap 9 closes an upper portion of the gas/air mixture chamber 102 of the inner part 6 to cause the gas/air mixture to be ejected through the flame ports 115 and 116 and provide the inner flame ring 38.

Modes of the Invention

Figure 7:
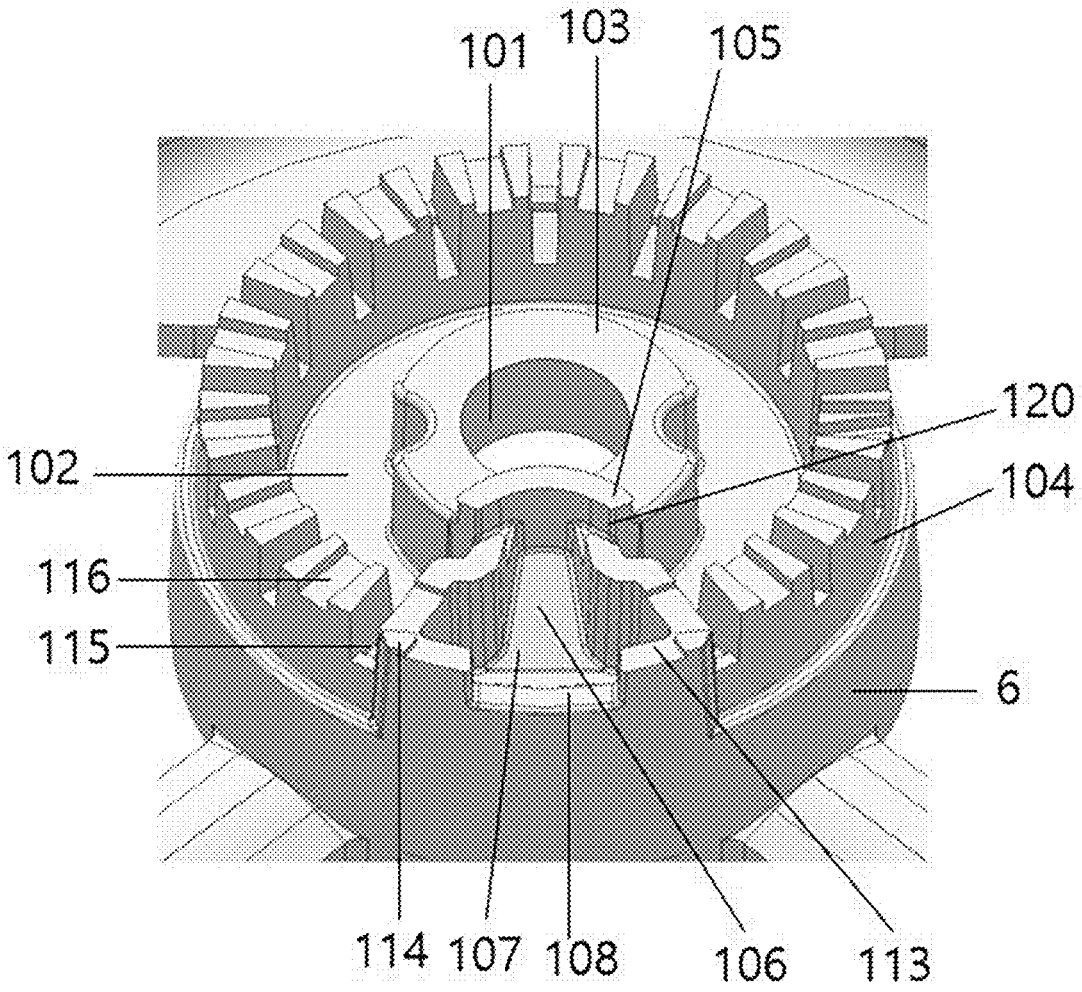
FIG. 7 is a partial view illustrating the inner part including a flame stability chamber and a flame stability port.

FIG. 7 is a partial view illustrating the inner part including a flame stability chamber and a flame stability port.

Figure 8:
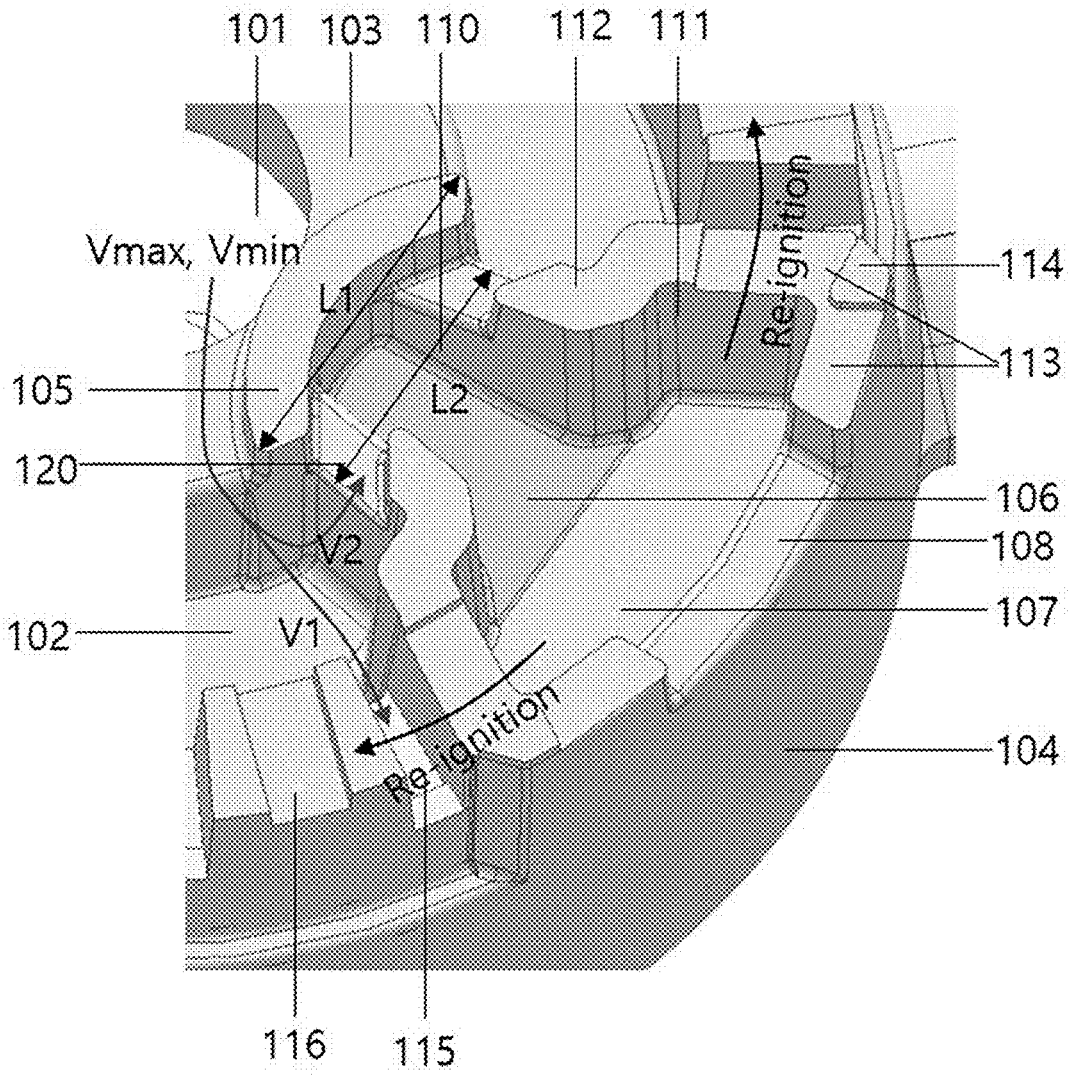
FIG. 8 is a partial view illustrating the flame stability chamber and the flame stability port from the side.

FIG. 8 is a partial view illustrating the flame stability chamber and the flame stability port from the side.

Figure 9:
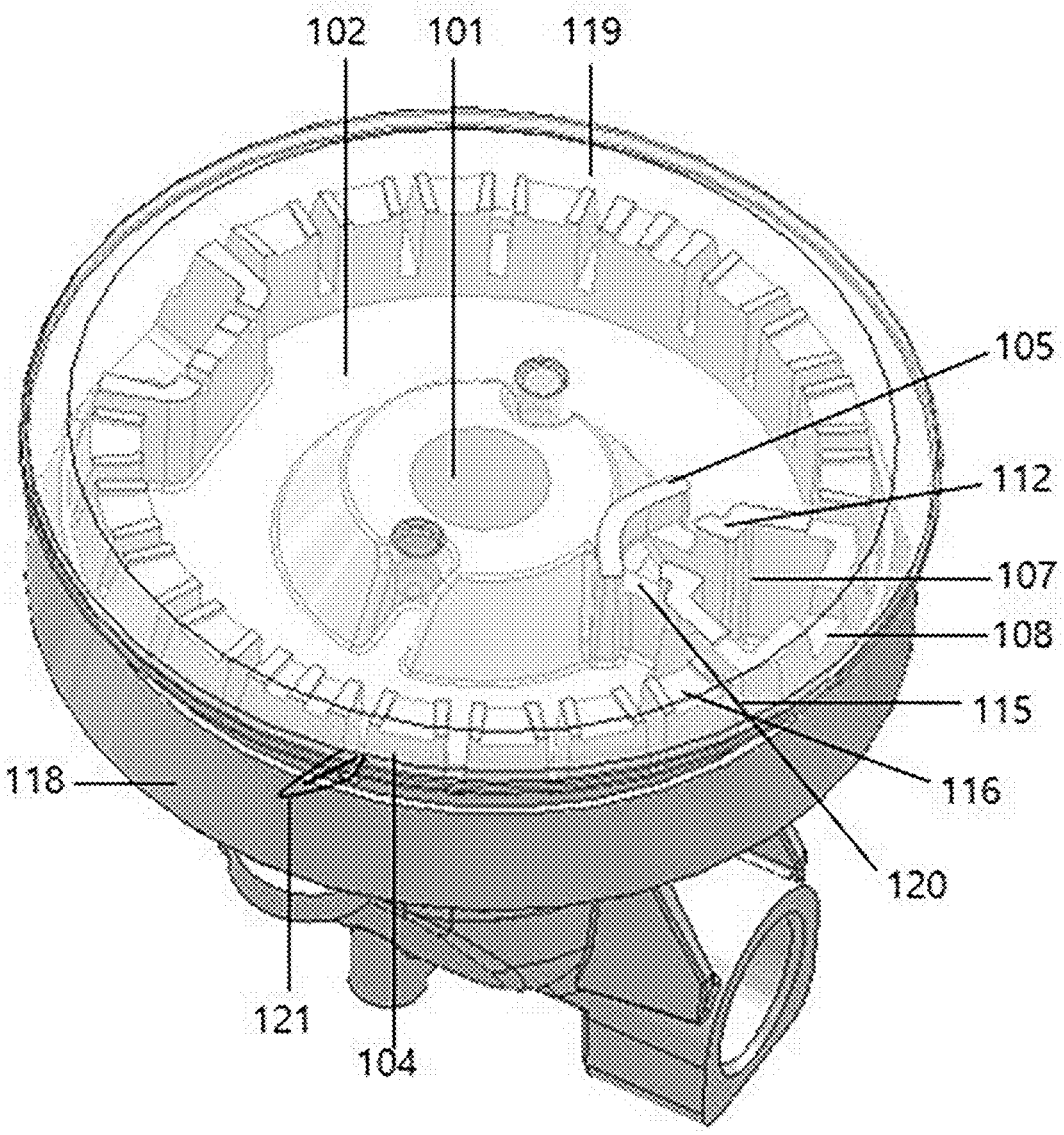
FIG. 9 is an overall view of a single type burner in which a cap of the single type burner is see-through to illustrate the flame stability chamber and the flame stability port.

FIG. 9 is an overall view of a single type burner in which a cap of the single type burner is see-through to illustrate the flame stability chamber and the flame stability port.

As shown in FIGS. 7, 8, and 9, a "flame extinguishment prevention structure" of an embodiment of the present invention is present in a head. The flame extinguishment prevention structure is a structure in which the flame stability chamber 107 and the flame stability port 108 configured to prevent flames from being extinguished are included in gas burner heads 6 and 118 that have an injector holder configured to fix an injector that injects gas, a Venturi tube having an upper portion closed with a cap to provide a flame ring and configured to introduce a gas/air mixture, and a plurality of main flame ports 115 and auxiliary flame ports 116 configured to eject the gas/air mixture. That is, even when flames of all the flame ports 115 and 116 are extinguished, flames of the flame stability port 108 that are not extinguished become a reignition source and serve to provide reignition to all the flame ports 115 and 116 and maintain flames of the burner.

The heads 6 and 118 include a gas/air mixture outlet 101 disposed at a rear end of a Venturi tube configured to discharge a gas/air mixture formed of gas injected from the injector, which communicates with a gas inlet, and air introduced thereinto, a mount 103 disposed at the highest position in the gas/air mixture chamber 102, and an annular outer wall 104 configured to arrange the gas/air mixture chamber 102, which stores the gas/air mixture, and the flame ports 115 and 116.

A roof 105 is disposed at the mount 103 or the gas/air mixture chamber 102 and may preferably have a streamlined shape or a triangular shape that is inclined from the gas/air mixture outlet 101 toward the gas/air mixture chamber 102. The roof 105 deflects a linear flow of the gas/air mixture discharged from the gas/air mixture outlet 101 to prevent the gas/air mixture from immediately entering the flame stability chamber 107.

One or more flame stability chamber inlets 120 are disposed under the roof 105 and inside the gas/air mixture chamber 102 and introduce gas into the flame stability chamber 107.

The roof 105 is disposed at the mount 103 to allow the gas/air mixture discharged from the gas/air mixture outlet 101 to flow at a high speed, and the flame stability chamber inlets 120 are disposed in the gas/air mixture chamber 102, whose volume sharply expands, to allow the gas/air mixture to flow at a low speed.

When one or more pairs of flame stability chamber inlets 120 are present, a length L2 between the one or more pairs of flame stability chamber inlets 120 is less than or equal to a length L1 of the roof 105. When a single flame stability chamber inlet 120 is present, the flame stability chamber inlet 120 is disposed inward from the roof 105.

A pair of baffles 112 are formed of parallel walls 110 that are symmetrical to each other and spaced apart from each other at a substantially constant interval in a direction from the roof 105 toward the annular outer wall 104 and expansion walls 111 that are symmetrical to each other and immediately expand past the parallel walls 110. The baffles 112 have upper portions closed with caps 9 and 119 to hold the gas/air mixture therein, and the gas/air mixture is introduced into the flame stability chamber 107 through the flame stability chamber inlet 120.

A bottom surface of the parallel wall 110 is an inclined bottom surface 106, which gradually lowers toward an entrance of the expansion wall 111, or a horizontal bottom surface that is horizontal. In particular, the inclined bottom surface 106 has a cross-sectional area gradually increasing toward the expansion wall 111 and thus slows down a flow of the gas/air mixture. When the flow of the gas/air mixture slows down at the inclined bottom surface 106, the gas/air mixture in the flame stability chamber 107 is less affected by the flow of the gas/air mixture of the inclined bottom surface 106 and is stably held and maintained.

The flame stability port 108 is disposed at the annular outer wall 104 that comes in contact with the pair of baffles 112. Flames of the flame stability port 108 have a low flame injection speed due to a large port area unlike flames of the flame port 115 and also have a different flame shape therefrom.

The flame stability chamber 107 holds the gas/air mixture to be supplied to the flame stability port 108 to prevent flames of the flame stability port 108 from being extinguished even when flames of the flame ports 115 and 116 are extinguished. Flames of the flame stability port 108 become a reignition source and provide reignition to all the flame ports 115 and 116 of the annular outer wall 104 through a reignition port 113. Flames of the flame stability port 108 are not extinguished because the flame stability chamber 107 is a chamber that is separated and independent from the gas/air mixture chamber 102, and even when a temporary lack of gas occurs, the gas/air mixture in the flame stability chamber 107 is temporarily supplied as a gas/air mixture necessary for combustion in the flame stability port 108 to maintain flames thereof. A temporary lack of gas occurs due to a rapid disturbing flow of surrounding air at predetermined low heating power, a backflow of gas around an injector due to quickly opening and closing an oven door, or instantaneous excessive primary air caused by a sudden change of a valve from high heating power to low heating power.

A flame separation blocking 114 may be disposed at the reignition port 113 for reignition between the flame stability port 108 and the main flame port 115 to affect flames of the flame stability port 108 and prevent the flames of the flame stability port 108 from being extinguished in a process in which flames of the flame port 115 are extinguished.

The flame extinguishment prevention structure prevents flames from being extinguished in a condition in which flames may be extinguished due to a temporary lack of gas but somewhat degrades homogeneity of flames. Therefore, the flame extinguishment prevention structure should maximally satisfy flame extinguishment prevention and flame homogeneity maintenance. Flame homogeneity maintenance means that a flame ring of the flame stability port 108 should not be excessively larger or smaller than flame rings of the flame ports, and flame rings of the flame ports 115 and 116 should have substantially constant sizes. In consideration of flame homogeneity maintenance, when the gas/air mixture is discharged from the gas/air mixture outlet 101 at the maximum speed Vmax, the flame extinguishment prevention structure of the present invention allows the gas/air mixture to collide with the roof 105, be deflected at a high speed V1, and flow to the flame port 115 so that the amount of gas/air mixture introduced into the flame stability chamber 107 is decreased, and the sizes of flames of the flame stability port 108 do not increase, and conversely, when the gas/air mixture is discharged at the minimum speed Vmin, the flame extinguishment prevention structure of the present invention maintains flames as the flow of the gas/air mixture slows down, and the gas/air mixture is introduced into a nearby flame stability chamber inlet 120 despite colliding with the roof 105.

In this way, the flame extinguishment prevention structure allows flame stability of the burner to be maintained not only at the maximum speed Vmax, the minimum speed Vmin, and other speeds therebetween of the gas/air mixture, but also during a temporary lack of gas.

Some embodiments of the present invention are illustrated in the drawings and have been described above, but those of ordinary skill in the art to which the present invention pertains may carry out the present invention in other specific forms without changing the technical spirit, range, or essential features of the present invention. Therefore, the embodiments described above should be understood as illustrative, instead of limiting, in all aspects. The scope of the present invention is shown by the claims below rather than by the detailed description above, and all changes or modifications derived from the meaning and scope of the claims and their equivalent concepts should be interpreted as belonging to the scope of the present invention.

The invention claimed is:

1. A gas burner comprising:

a head closed with a cap and formed of an outer part having a plurality of outer flame ports and an inner part spaced apart from the outer part and having a plurality of flame ports disposed at a central portion;

an injector holder assembled to a top plate of a cooking appliance, having at least one portion disposed to be spaced apart from the head, including two or more first Venturi tubes horizontally disposed therein while spaced apart, and configured to fix a first injector through which a gas is introduced from the outside;

an expansion chamber configured to communicate with one end of each of the two or more first Venturi tubes and communicate with an outer annular chamber of the outer part;

an upright vertical channel of the expansion chamber that is configured to allow communication between the expansion chamber and the outer annular chamber;

a second Venturi tube vertically disposed in the inner part of the head; and a second injector that is fixed to a center of an upper surface of the injector holder, spaced apart from the second Venturi tube to inject a gas into the second Venturi tube, positioned higher than the upper surface of the injector holder, and open, wherein the upright vertical channel is disposed to minimize a distance between the head and the expansion chamber, and increase an amount of primary air into the head by moving a gas-air mixture that passes through an outlet of each of the two or more first Venturi tubes and reaches the expansion chamber to the outer annular chamber of the outer part.

2. The gas burner of claim 1, wherein:

one of the two or more first Venturi tubes includes a first Venturi tube diffuser disposed at one end far from the first injector; and the Venturi tube diffuser communicates with the expansion chamber.

3. The gas burner of claim 1, wherein the injector holder includes, by an end of a lower surface of a portion far from the first Venturi tube diffuser forming a slope, a distribution inclined surface configured to allow a gas/air mixture to evenly flow to the outer annular chamber through the vertical channel.

* * * * *